US006164265A

United States Patent [19]

Yip et al.

[11] Patent Number: 6,164,265

[45] Date of Patent: Dec. 26, 2000

[54] FEEDBACK LOAD CONTROL FOR POWER STEERING

[75] Inventors: James Wah Yip, Pinckney; Daniel B. Diebel, Ypsilanti; Michael J. Prucka, Lake Orion, all of Mich.

[73] Assignee: DaimlerChrysler Corporation, Auburn Hills, Mich.

[21] Appl. No.: 09/375,890

[22] Filed: Aug. 17, 1999

[51] Int. Cl.[7] ..... F02M 3/00

[52] U.S. Cl. ..... 123/339.21; 123/339.23

[58] Field of Search ..... 123/339.21, 339.23, 123/339.27

[56] References Cited

U.S. PATENT DOCUMENTS

| | | | |
|---|---|---|---|
| 4,225,003 | 9/1980 | Yoshimura . | |
| 4,492,195 | 1/1985 | Takahashi et al. . | |
| 4,545,449 | 10/1985 | Fujiwara . | |
| 4,724,810 | 2/1988 | Poirier et al. . | |
| 5,097,808 | 3/1992 | Tanaka et al. . | |
| 5,343,840 | 9/1994 | Wataya et al. | 123/339.23 |
| 5,408,871 | 4/1995 | Lieder et al. | 123/339.21 |
| 5,431,175 | 7/1995 | Beckett et al. . | |
| 5,531,287 | 7/1996 | Sherman . | |
| 5,553,589 | 9/1996 | Middleton et al. . | |
| 5,666,917 | 9/1997 | Fraser et al. . | |
| 5,947,084 | 9/1999 | Russell et al. | 123/339.23 |
| 6,009,852 | 1/2000 | Akabori et al. | 123/339.21 |

*Primary Examiner*—John Kwon
*Attorney, Agent, or Firm*—Mark P. Calcaterra

[57] ABSTRACT

A method for controlling the idle of an engine includes the step of determining a proportional airflow term by monitoring the difference between an engine idle speed and a target idle speed. In addition, an integral airflow term is determined. The method further includes the steps of determining a derivative airflow term by monitoring a rate of change of the engine idle speed and defining a limited derivative airflow term bounded by an upper limit and a lower limit. A total proportional, integral, derivative airflow is determined by summing the proportional airflow term, the integral airflow term and the limited derivative airflow term. The total airflow is then delivered to an engine control system.

9 Claims, 4 Drawing Sheets

Derivative RPM Error to Derivative Gain Look-up Table

X (input) : RPM Error
Y (output) : Derivative Gain

| RPM Error | Derivative Gain |
|---|---|
| -200 | 1.024 |
| -50 | 0.896 |
| -8 | 0.768 |
| -4 | 0.000 |
| 0 | 0.000 |
| 2 | 0.768 |
| 16 | 0.768 |
| 24 | 0.896 |
| 48 | 1.024 |

FEEDBACK LOAD CONTROL FOR POWER STEERING

BACKGROUND OF THE INVENTION

1. Technical Field

The present invention generally pertains to motor vehicles. More particularly, the present invention pertains to a feedback load control system for a vehicle equipped with power steering. More specifically, but without restriction to the particular embodiment and/or use which is shown and described for purposes of illustration, the present invention relates to a proportional, integral, derivative control system used in conjunction with a linear solenoid to provide bypass airflow when an increase in engine load by an accessory is sensed.

2. Discussion

Motor vehicles equipped with small displacement engines such as a 2.0 litre 4 cylinder engine, are highly susceptible to stalling when an accessory such as a power steering pump is operated while the engine is at idle speed. Specifically, when a vehicle operator turns the steering wheel, a demand for increased hydraulic pressure in the power steering system occurs. As the power steering pump fulfills the requirement for increased hydraulic pressure, a significant load is placed upon the engine to rotate the pump. Accordingly, without an engine control system to compensate for the increased load generated by the power steering system, the engine speed will fall, possibly stalling the engine.

Conventional control systems implement a power steering switch to signal the engine control system that the power steering system is being utilized. The switch closes once hydraulic pressure in the power steering system reaches a set point corresponding to a pressure greater than that found in the system when the steering wheel is not being turned. Once the power steering switch is closed, the engine control module is signaled to compensate for the increase in load by increasing airflow. This system has some inherent problems.

Because a certain pressure is required to trigger the power steering switch, an increase in load on the engine has already occurred. Once the switch does close, additional air begins to be delivered to the combustion chambers. However, there is a substantial time lag between the power steering switch closing and additional air entering the combustion chambers. In order to keep the engine from stalling, an amount of air capable of offsetting a full power steering load is input. This relatively large air input is required because it is not known if the sensed pressure increase was generated from a small turning of the steering wheel or a full lock. Accordingly, these systems are prone to cause excessive airflow to be introduced into the engine when the steering wheel is rocked even slightly, thereby causing the engine speed to flare upward.

Another known issue associated with the use of power steering system pressure switches arises in cold weather operation. Conventional systems utilizing a power steering switch to sense an increase in pressure are subject to false triggers of the switch based on an increase in viscosity of the cold power steering fluid.

SUMMARY OF THE INVENTION

It is therefore an object of the present invention to provide an improved engine control system which utilizes a feedback load control to compensate for engine loads due to automobile accessories.

It is yet another object of the invention to provide a method of power steering load compensation without the use of a power steering switch, its associated wiring, and electronics.

According to the invention, there is provided a proportional, integral, derivative control system used in conjunction with a linear solenoid to provide bypass airflow when an increase in engine load by an accessory is sensed.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figures 1, 4:
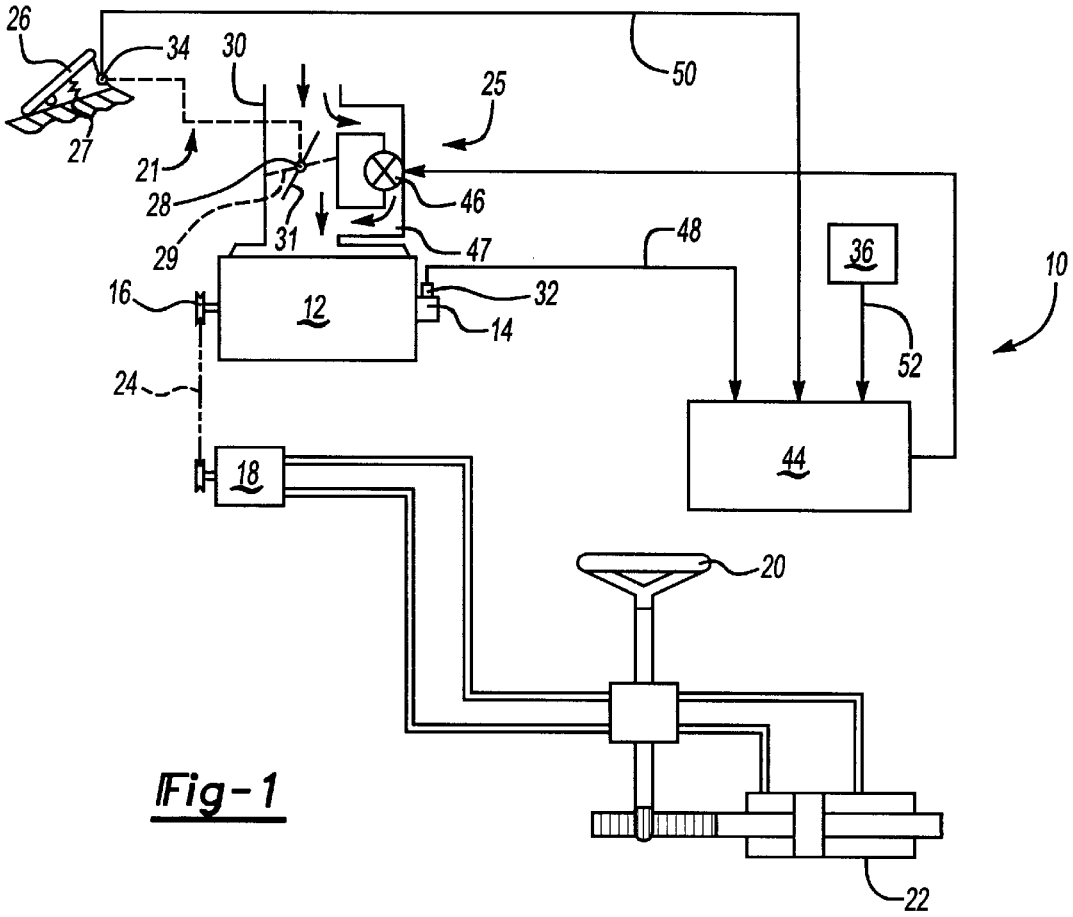
FIG. 1 is a schematic diagram of a motor vehicle powertrain including a feedback load control system of the present invention.
FIG. 4 is a chart representative of a look-up table.

With initial reference to FIG. 1, a motor vehicle constructed in accordance with the teachings of an embodiment of the present invention is generally identified at reference numeral 10. Motor vehicle 10 includes an engine 12 having an output shaft 14 for supplying power to drive line components and driven wheels (not shown). Engine 12 also includes a pulley 16 for supplying energy to a variety of automotive accessories including power steering pump 18.

Upon rotation of steering wheel 20, power steering pump 18 increases the hydraulic fluid pressure in one of the ends of steering cylinder 22 in order to provide a power assist to the operator of the vehicle when turning the wheels. Because pulley 16 is continuously coupled to power steering pump 18 via a belt 24, an increased load is placed upon engine 12 when the power steering fluid pressure is increased.

The magnitude of power generated by engine 12 is controlled by two separate systems. A first engine output control system 21 includes an operator controlled accelerator pedal 26 electronically or mechanically coupled to throttle blade 28 positioned within throttle body 30. As the operator depresses accelerator pedal 26, throttle blade 28 rotates from a substantially closed position (as shown by phantom line 29) to an open position (as shown at 31) to cause an increase in air and fuel delivery thereby increasing the engine output power. When accelerator pedal 26 is not being depressed by an operator, pedal spring 27 biases accelerator pedal 26 to a returned position. Accordingly, throttle blade 28 returns to the substantially closed position 29 at which time engine 12 operates at an idle speed.

A second control system 25, or feedback load control system of the present invention, operates to compensate for the increased engine load due to vehicle accessories such as power steering pump 18. Specifically, a linear solenoid 46 is actuated to provide channel airflow through intake channel 47 to the combustion chambers of engine 12. Accordingly, the power output of engine 12 is increased to compensate for the engine accessory.

Second control system 25 utilizes inputs from an engine speed sensor 32, an accelerator pedal position sensor 34, a vehicle speed sensor 36, a control unit 44 and linear solenoid 46 to compensate for increased engine loads caused by vehicle accessories such as power steering pump 18. Each of sensors 32, 34 and 36 supply input signals to control unit 44 via lines 48, 50 and 52 respectively. For example, engine speed sensor 32 supplies engine speed signal RPM to control unit 44 on line 48. The remaining signals and their use will be described in greater detail hereinafter.

Figure 2:
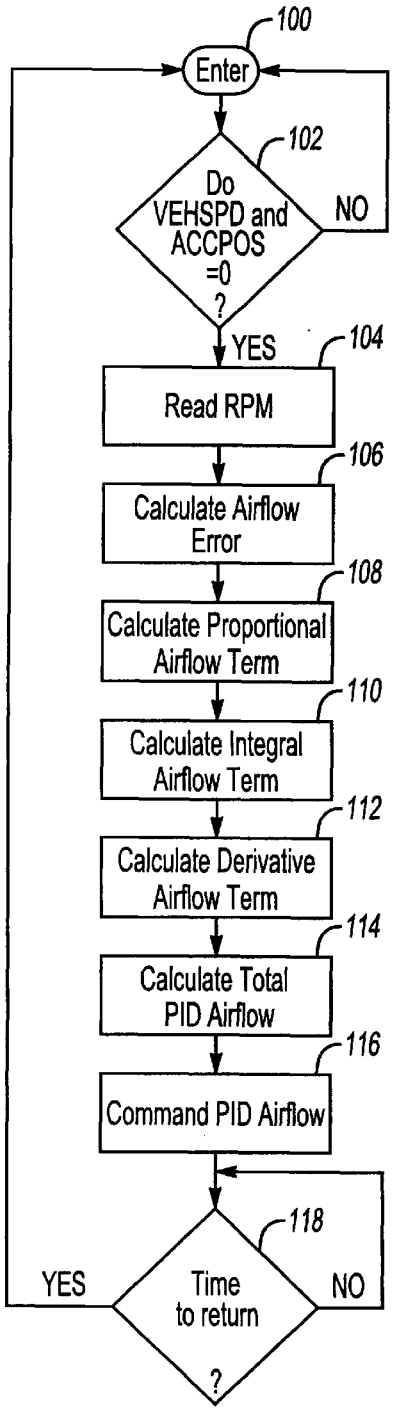
FIG. 2 is a flow diagram representative of the computer program instructions executed by the feedback load control system of the present invention.
Figure 3:
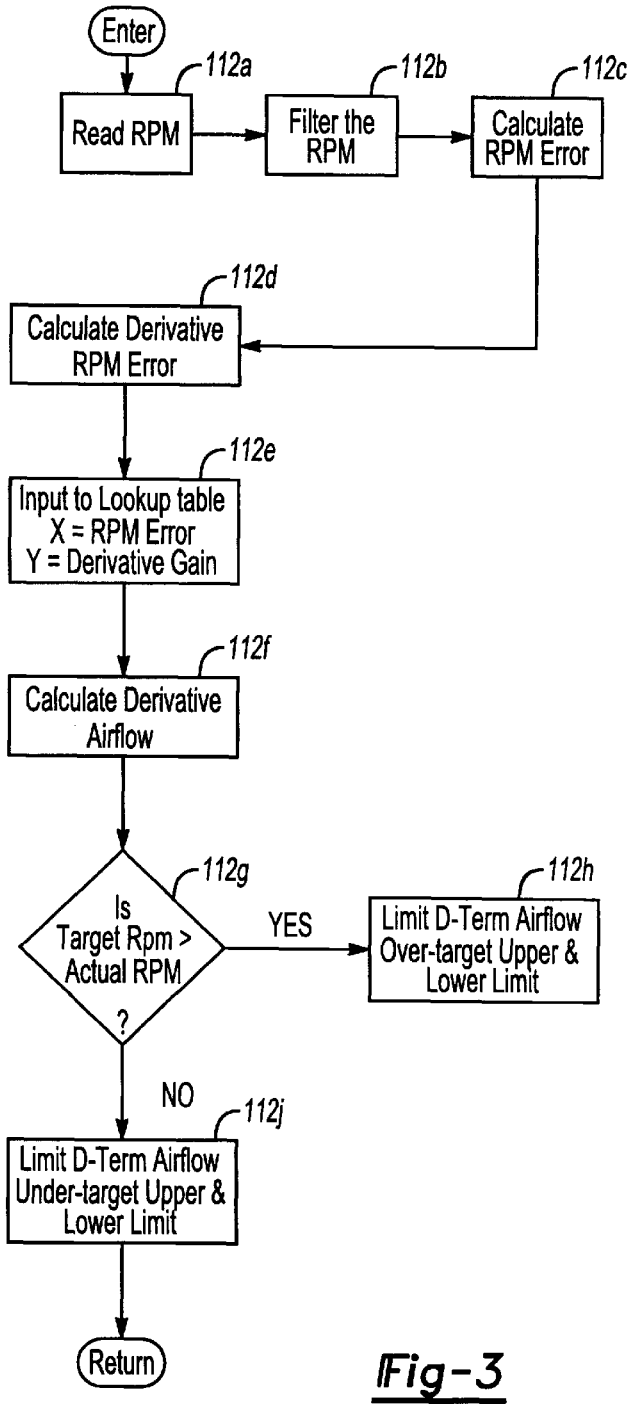
FIG. 3 is a flow diagram representative of the computer program instructions executed to determine a derivative airflow term.

FIGS. 2 and 3 depict flow diagrams representative of the computer program instructions executed by control unit 44 in carrying out the control functions of this invention. Specifically, FIG. 2 depicts the global program utilized to provide feedback load control for power steering according to the present invention. Block 100 includes a series of instructions to take initial readings from each of sensors 32, 34 and 36 executed at the beginning of each program loop. Block 102 compares the initial readings of accelerator pedal position signal (ACCPOS) and vehicle speed sensor (VEHSPD) to set reference values to determine if the feedback load control system is to be invoked. If block 102 has been satisfied, block 104 directs control unit 44 to read the engine speed signal (RPM). Blocks 106–114 perform further calculations to determine the proportional airflow term, integral airflow term, derivative airflow term and total PID airflow. Once each of the calculations have been executed, control unit 44 commands linear solenoid 46 to maintain a position within intake channel 47 as depicted in block 116. One skilled in the art will appreciate that linear solenoid 46 may be positioned in an infinite number of locations ranging from a fully closed position to a fully open position. Block 118 indicates that previous instructions defined by blocks 100–116 are repeated in the form of a loop once a certain trigger occurs.

The function of each of the steps depicted in FIG. 2 are now described in greater detail. At block 100, control unit 44 takes an initial sampling of data from each of the sensors 32–36 as shown in FIG. 1. As referenced earlier, two of the signals first utilized are accelerator pedal position ACCPOS and vehicle speed VEHSPD. Block 102 acts as a gate for invoking the feedback load control system by allowing the program to progress to block 104 only after ACCPOS corresponds to a condition where the vehicle operator is not depressing accelerator pedal 26. In addition, the program will not continue to block 104 unless VEHSPD is zero. Accordingly, the feedback load control system is to be invoked when the vehicle is resting at an idle.

Once the initial screening block 102 has been satisfied, block 104 collects the RPM signal from engine speed sensor 32. One skilled in the art will appreciate that the RPM signal provides the feedback mechanism for the control system. Accordingly, each of the subsequent calculations are based in some manner on RPM. At block 106, airflow error (AIRERR) is calculated as follows:

$$\text{AIRERR}=\text{Target RPM}-\text{RPM}$$

Accordingly, the airflow error term AIRERR indicates how far the system is currently operating from a target RPM 120.

In general, the feedback load control system calculates a proportional, an integral and a derivative term as a function of RPM. As mentioned earlier, RPM may be varied by regulating the amount of air allowed to pass through intake channel 47, past linear solenoid 46. The total amount of airflow supplied through the use of the feedback load control for the power steering system is calculated by summing the proportional airflow term, the integral airflow term, and the derivative airflow term. In block 108, the proportional term airflow is calculated.

$$\text{Proportional airflow term}=\text{AIRERR}*\text{proportional gain}$$

One skilled in the art will appreciate that proportional gain is simply a multiplier used to scale the proportional airflow term. As shown in FIG. 2, block 110 calculates an integral airflow term.

$$\text{Integral airflow term}=\text{integral airflow term (old)}+\text{AIRERR}*\text{integral gain}*\text{time}$$

In order to define the integral airflow term, an understanding of the time term must first exist. As shown in FIG. 2, block 118 controls the frequency with which control unit 44 samples each of the inputs. Specifically, block 118 allows the program to loop based on two separate criteria. Firstly, the program will loop each time an engine cylinder fires. For example, in a four cylinder engine operating at idle speed, the time between successive firings is approximately 90 milliseconds. Secondly, the data collection frequency is limited by the data collection speed of control unit 44. Therefore, even if the engine is operating at a speed where the next firing occurs at a time less than the minimum data sampling speed of the control unit, block 118 directs the program to loop only after the minimum data collection time has passed. Accordingly, the time term found in the equation for integral airflow term corresponds to the loop time previously described. To further clarify the above equation, integral airflow term (old) is the integral airflow term calculated during the previous pass through the program. One skilled in the art will appreciate that during the first pass through the global program, integral airflow term (old) is set at zero.

Figure 5:
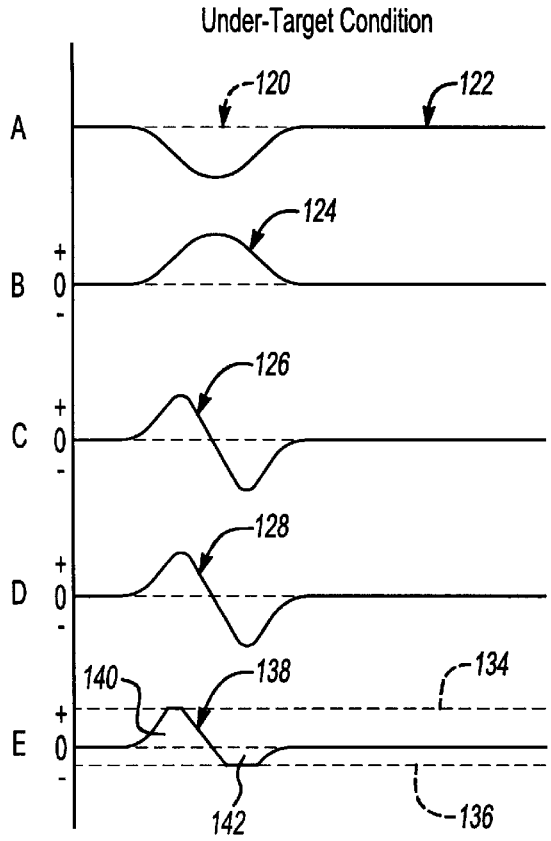
FIG. 5 is a state diagram showing a graphical representation of the limited derivative airflow term during an under-target condition.

Block 112 represents a calculation of the derivative airflow term. As shown in FIG. 3, blocks 112A–112J illustrate the series of instructions performed to calculate the derivative airflow term. In addition, FIGS. 5 and 6 each include lines A–D corresponding to each of blocks 112B, 112C, 112D, and 112F respectively. FIG. 5, line E, corresponds to block 112H and Line E of FIG. 6 corresponds to block 112J. Block 112A is simply reading RPM as provided from sensor 32. At times, the RPM trace may have spikes due to noise in the signal that falsely represent a large increase or decrease in RPM. Accordingly, as shown in block 112B and FIG. 5, RPM is filtered to provide Filter RPM 122 as an accurate representation of the actual engine speed.

$$\text{Filter RPM}_{new}=(1\text{-filter RPM}_{old}*\text{RPM}+(\text{filter RPM}_{old}*\text{RPM})$$

In similar fashion to the method of calculating the integral airflow term, filter $\text{RPM}_{old}$ is the filter RPM value calculated during the prior loop of the program. Once the engine speed signal has been filtered in block 112B, an RPM error 124 (shown in FIG. 5) is calculated by comparing filter RPM 122 to target RPM 120 in Block 112C as follows:

$$\text{RPM error}=\text{filter RPM}-\text{target RPM}.$$

Figure 6:
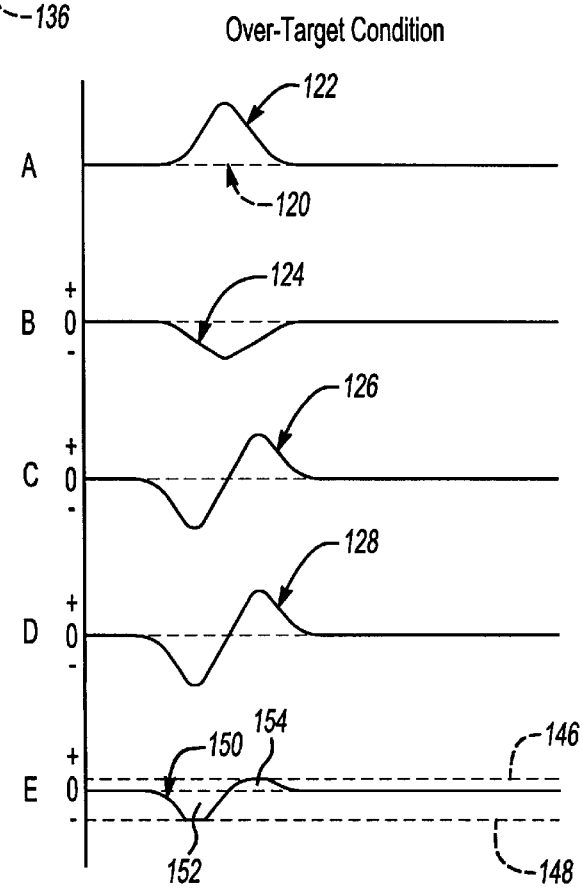
FIG. 6 is a state diagram showing a graphical representation of the limited derivative airflow term during an over-target condition.

Block 112D represents the calculation for a derivative RPM error 126 shown graphically in FIGS. 5 and 6. Derivative RPM error 126 is calculated based on the change in RPM error 124 over time. Accordingly, derivative RPM error 126 is calculated by taking the difference between the current RPM error and the RPM error calculated during the previous program loop. Specifically, the equation reads:

$$\text{derivative RPM error}=\text{RPM error}-\text{RPM error}_{old}.$$

The operations of block 112E involve using a look-up table to determine derivative gain based on derivative RPM error 126 as shown in FIG. 4. If the exact RPM error is not found in the look-up table, control unit 44 performs an interpolation operation as is commonly know in the art. The table of FIG. 4 is constructed by charting empirical data determined from a specific engine and air bypass system. Once derivative gain has been determined from the look-up table, a derivative airflow term 128 may be determined as shown in block 112F.

Derivative airflow term=derivative gain*derivative RPM error*RPM to airflow conversion factor The RPM to airflow conversion factor is a constant defined by the specific engine size and breathing characteristics of a certain engine.

Once derivative airflow term 128 is defined, it must fall within one of the following limiting parameters before the airflow will actually be delivered. The process steps labelled 112G, 112H and 112J assure proper use of the derivative airflow term within the control system. Systems that do not utilize the limiting instructions of steps 112G–112J, are prone to uncontrolled oscillation of the feedback term. Difficulty in the use of an unlimited derivative term arises because engine speed does not immediately react to a change in the position of linear solenoid 46. A certain amount of time is required for the air to travel through intake channel 47 and into the combustion cylinders. Derivative type control without limits will tend to overcompensate for each deviation from target resulting in an overshoot past the target ultimately producing an oscillatory condition.

In order to prevent engine oscillation, block 112G first determines if target RPM 120 is greater than filter RPM 122 creating an under-target condition or if filter RPM 122 is greater than target RPM 120 creating an over-target condition. If target RPM 120 is greater than filter RPM 122, block 112H controls. As best seen in FIGS. 5 and 6, derivative RPM 128 is limited based on the initial assessment of under-target or over-target condition. FIG. 5 depicts an under-target condition while FIG. 6 presents an over-target condition. As shown on Line E of FIG. 5, the under-target upper limit 134 is a greater distance from zero than the under-target lower limit 136. Accordingly, the limited derivative airflow term curve 138 defines a large positive first area 140 for quickly responding to the sensed under-target condition. Limited derivative airflow term curve 138 further defines a second area 142 smaller than first area 140. Use of asymmetric limits 134 and 136 greatly reduces the tendency for overcompensation once the actual RPM begins to approach the target RPM. More particularly, under-target lower limit 136 clips the lower portion of derivative airflow term 128 in order to allow time for the air to pass by linear solenoid 46 through intake channel 47 and enter the combustion chambers. Accordingly, a stable RPM results as shown in Line A of FIG. 5.

Referring to FIG. 3, if the target RPM is not greater than the actual RPM, block 112J controls. In similar fashion to the under-target condition earlier described, an over-target derivative airflow term 128 is limited by an over-target upper limit 146 and an over-target lower limit 148 as shown in FIG. 6. Because the condition to correct is an over-target condition, a limited derivative airflow term curve 150 defines a negative first portion 152. One skilled in the art will appreciate that negative portion 152 encompasses a greater area between limited derivative airflow term curve 150 and zero than area 154 defined by the positive portion of limited derivative airflow term curve 150 and zero. Once again, the first portion in time, portion 152, is large due to the need to quickly correct the over-target condition. On the other hand, over-target upper limit 146 clips much of the positive portion of the derivative airflow term in order to account for the time it takes the air to travel from linear solenoid 46 to the combustion chambers.

Referring to FIG. 2, once the derivative airflow term has been calculated in block 112, the program advances to block 114 to calculate a total PID airflow.

Total PID Airflow=Proportional Airflow Term+Integral Airflow Term+Limited Derivative Airflow Term At block 116, control unit 44 commands linear solenoid 46 to maintain a position corresponding to the magnitude of Total PID airflow requested. One skilled in the art will appreciate that linear solenoid 46 is only one example of an engine control system capable of varying engine speed and that the scope of the invention is not limited to the embodiment presented. Finally, block 118 acts as a gate determining when the program will loop back to block 100. As described earlier, the program will return to block 100 when the next engine cylinder fires or after the minimum control unit sample time has expired, whichever is longer.

Figure 7:
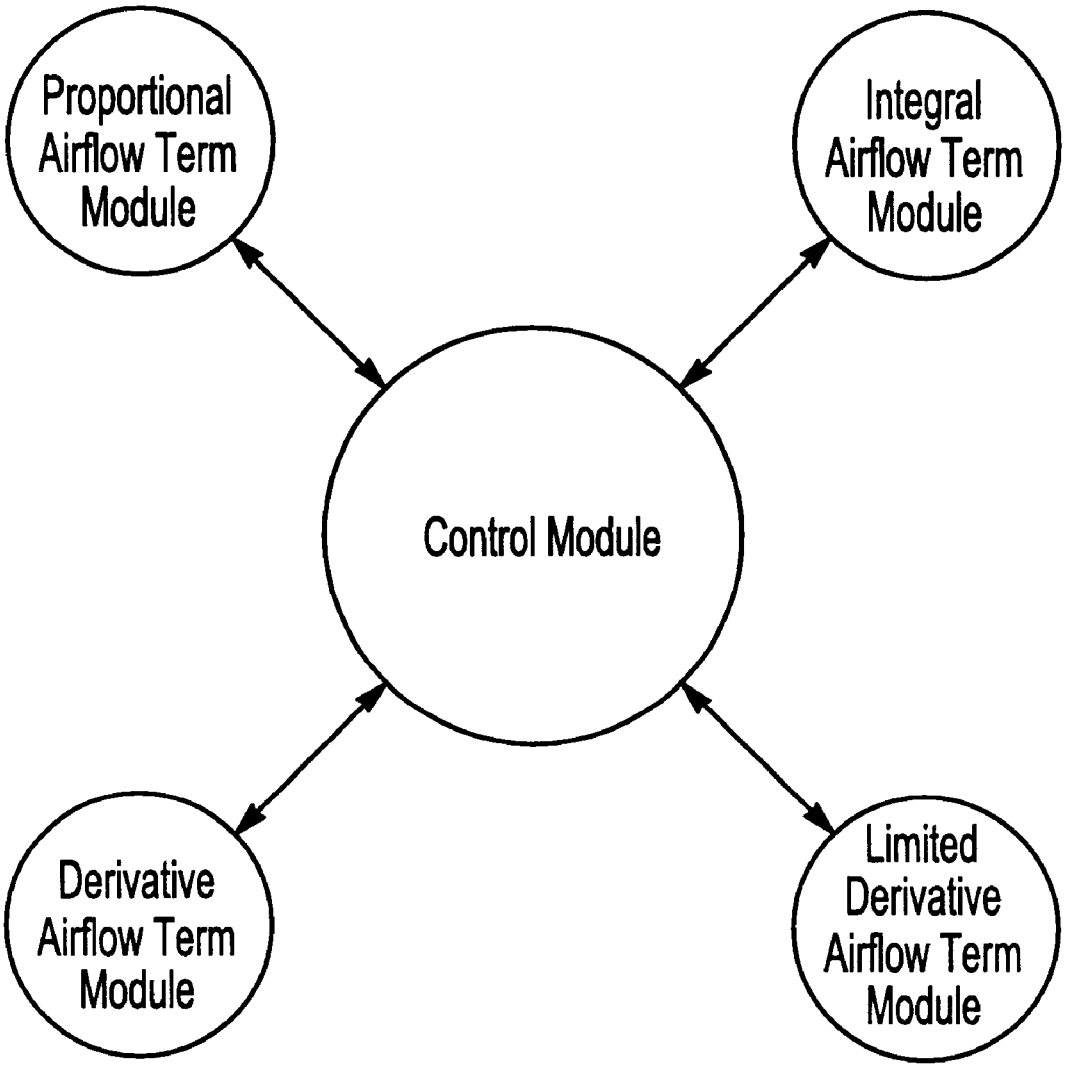
FIG. 7 is a logic diagram showing a graphical representation of the feedback load control system of the present invention.

In addition, one skilled in the art will appreciate that the afore-mentioned logical steps may be performed by individual modules in communication with each other as shown in FIG. 7. Control module 200 is in communication with proportional airflow term module 202, integral airflow term module 204, derivative airflow term module 206 and limited derivative airflow term module 208.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. An idle speed control system for a motor vehicle comprising:

an engine;

an airflow delivery device coupled to said engine; and a control unit in communication with said airflow delivery device wherein an idle speed of said engine is controlled based on a proportional airflow term, an integral airflow term and a limited derivative airflow term.

2. A method for controlling the idle of an engine comprising the steps of:

determining a proportional airflow term by monitoring the difference between an engine idle speed and a target idle speed;

determining an integral airflow term;

determining a derivative airflow term by monitoring a rate of change of the engine idle speed;

defining a limited derivative airflow term as the derivative airflow term bounded by an upper limit and a lower limit;

determining a total PID airflow by summing the proportional airflow term, the integral airflow term and the limited derivative airflow term; and delivering said total PID airflow to an engine control system.

3. The method for controlling the idle of an engine of claim 2 wherein the step of determining a proportional airflow term includes a proportional gain.

4. The method of controlling the idle of an engine of claim 2 wherein the step of determining a derivative airflow term is based upon a derivative of engine speed over time.

5. The method of controlling the idle of an engine of claim 2 wherein said upper limit and said lower limit are unequally spaced from zero.

6. The method of controlling the idle of an engine of claim 2 wherein said engine control system includes a solenoid positioned in an intake channel wherein said solenoid position defines a quantity of air allowed to enter a combustion chamber.

7. An idle speed control system for a motor vehicle comprising:

a control module;

a proportional airflow term module for determining a proportional airflow term, said proportional airflow term module in communication with said control module;

an integral airflow term module for determining an integral airflow term, said integral airflow term module in communication with said control module;

a derivative airflow term module for determining a derivative airflow term, said derivative airflow term module in communication with said control module;

a limited derivative airflow term module for bounding said derivative airflow term by an upper limit and a lower limit;

wherein said controller module sums said proportional airflow term, said integral airflow term and said limited derivative airflow term to direct an engine control scheme.

8. The idle speed control system of claim 7 wherein said upper and lower limits asymmetrically encompass a zero point.

9. The idle speed control system of claim 7 wherein the engine control scheme includes an air delivery device separate from an operator controlled air delivery device.

* * * * *